US009974133B2

(12) United States Patent
Gras et al.

(10) Patent No.: US 9,974,133 B2
(45) Date of Patent: May 15, 2018

(54) OPTOELECTRONIC CIRCUIT COMPRISING LIGHT-EMITTING DIODES

(71) Applicant: EASII IC, Grenoble (FR)

(72) Inventors: David Gras, Echirolles (FR); Thomas Peysson, La Buisse (FR)

(73) Assignee: EASII IC, Grenoble (FR)

( * ) Notice: Subject to any disclaimer, the term of this patent is extended or adjusted under 35 U.S.C. 154(b) by 0 days. days.

(21) Appl. No.: 15/719,612

(22) Filed: Sep. 29, 2017

(65) Prior Publication Data

US 2018/0098394 A1 Apr. 5, 2018

(30) Foreign Application Priority Data

Sep. 30, 2016 (FR) ..... 16 59452

(51) Int. Cl.
*H05B 37/02* (2006.01)
*H05B 33/08* (2006.01)

(52) U.S. Cl.
CPC ..... *H05B 33/083* (2013.01)

(58) Field of Classification Search
CPC .... H05B 41/34; H05B 33/0803; H05B 39/09; H05B 41/28; H05B 33/0809; H05B 41/295; H05B 41/2827; H05B 41/3925; H05B 33/0815; H05B 33/0818; H05B 41/2828; H05B 41/3921; H05B 41/3927; H05B 37/029; H05B 37/0254; H05B 37/02; Y02B 20/202
See application file for complete search history.

(56) References Cited

U.S. PATENT DOCUMENTS

2012/0299484 A1 11/2012 Shin
2013/0200802 A1 8/2013 Sakuragi et al.

OTHER PUBLICATIONS

Preliminary Search Report, French Application No. 1659452, 2 pages.

*Primary Examiner* — Minh D A
(74) *Attorney, Agent, or Firm* — Moreno IP Law LLC

(57) ABSTRACT

An optoelectronic circuit intended to receive a variable voltage containing an alternation of rising and falling phases. The optoelectronic circuit includes assemblies of series-assembled light-emitting diodes, a node coupled to each assembly by a conduction circuit having its electric conductance varying according to a control signal and a control circuit coupled to each conduction circuit and capable of supplying each control signal based on the comparison of a first voltage at said node with at least a second voltage. The control circuit includes a difference amplifier and as many output stages as there are conduction circuits, the control circuit being capable of controlling the first voltage with the second voltage offset by a third voltage, different for each output stage.

13 Claims, 3 Drawing Sheets

OPTOELECTRONIC CIRCUIT COMPRISING LIGHT-EMITTING DIODES

FIELD

The present description relates to a optoelectronic circuit, particularly to an optoelectronic circuit comprising light-emitting diodes.

BACKGROUND

It is desirable to be able to power a optoelectronic circuit comprising light-emitting diodes with an AC voltage, particularly a sinusoidal voltage, for example, the mains voltage.

FIG. 1 shows an example of an optoelectronic circuit 10 comprising input terminals $IN_1$ and $IN_2$ having an AC voltage $V_{IN}$ applied between them. Optoelectronic circuit 10 further comprises a rectifying circuit 12 comprising a diode bridge 14, receiving voltage $V_{IN}$ and supplying a rectified voltage $V_{ALIM}$ which powers light-emitting diodes 16, for example, series -assembled with a resistor 15. The current flowing through light-emitting diodes 16 is called $I_{ALIM}$.

FIG. 2 is a timing diagram of power supply voltage $V_{ALIM}$ and of power supply current $I_{ALIM}$ for an example where AC voltage $V_{IN}$ corresponds to a sinusoidal voltage. When voltage $V_{ALIM}$ is greater than the sum of the threshold voltages of light-emitting diodes 16, light-emitting diodes 16 become conductive. Power supply current $I_{ALIM}$ then follows power supply voltage $V_{ALIM}$. There is therefore an alternation of phases OFF without light emission and of light -emission phases ON.

A disadvantage is that as long as voltage $V_{ALIM}$ is smaller than the sum of the threshold voltages of light-emitting diodes 16, no light is emitted by optoelectronic circuit 10. An observer may perceive this lack of light emission when the duration of each phase OFF with no light emission between two light-emission phases ON is too long. A possibility, to increase the duration of each phase ON, is to decrease the number of light-emitting diodes 16. A disadvantage then is that the proportion of electric power lost in the resistor is significant.

Publication US 2014/0252968 describes an optoelectronic circuit where the number of light-emitting diodes receiving power supply voltage $V_{ALIM}$ progressively increases during a rising phase of the power supply voltage and progressively decreases during a falling phase of the power supply voltage. This is achieved by a switching device capable of short-circuiting a variable number of groups of light-emitting diodes according to the variation of voltage $V_{ALIM}$. This enables to decrease the duration of each phase with no light emission.

A disadvantage of the optoelectronic circuit described in publication US 2014/0252968 is that it requires using a difference amplifier for each group of light-emitting diodes. The circuit may thus have a high manufacturing cost. Another disadvantage is that the electric power consumption of the optoelectronic circuit may be significant. Another disadvantage is the complexity of the optoelectronic circuit, which may cause reliability issues.

Publication US-A-2013/0200802 describes an optoelectronic circuit comprising a plurality of series-assembled diodes and a switching device capable of short-circuiting a greater or lesser number of light emitting diodes according to the variation of the power supply voltage. The switching circuit comprises a differential amplifier.

SUMMARY

An object of an embodiment is to overcome all or part of the disadvantages of the previously-described optoelectronic circuits.

Another object of an embodiment is to decrease the duration of phases with no light emission of the optoelectronic circuit.

Another object of an embodiment is for the current powering the light-emitting diodes to vary substantially continuously.

Another object of an embodiment is to have a decreased number of components of the optoelectronic circuit switching device.

Thus, an embodiment provides an optoelectronic circuit intended to receive a variable voltage containing an alternation of rising and falling phases, the optoelectronic circuit comprising:

assemblies of series-assembled light-emitting, diodes;

a node coupled to each assembly by a conduction circuit having an electric conductance which varies according to a control signal; and a control circuit coupled to each conduction circuit, comprising a difference amplifier and as many output stages as there are conduction circuits, and capable of supplying each control signal based on the comparison of a first voltage at said node with at least a second voltage identical for all conduction circuits, the control circuit being capable of controlling the first voltage with the second voltage offset by a third voltage, different for each output stage.

According to an embodiment, the difference amplifier receives as an input a differential voltage corresponding to the difference between the first voltage and the second voltage.

According to an embodiment, the difference amplifier is capable of supplying a first current and a second current, the control circuit comprising a first current mirror with a plurality of outputs capable of copying, for each conduction circuit, the first current or a third current multiplied by a first copying factor, and a second current mirror with a plurality of outputs capable of copying, for each conduction circuit, the second current or the third current multiplied by a second copying factor, the ratio of the first copying factor to the second copying factor being different for each conduction circuit.

According to an embodiment, the assemblies of light-emitting diodes are ordered by increasing rank from a first assembly at a first end of the series to a last assembly at a second end of the series and, for each conduction circuit, the control circuit is capable of controlling the first voltage with the second voltage decreased by a third voltage which decreases with the rank of the assembly having the conduction circuit coupled thereto.

According to an embodiment, the difference amplifier comprises a differential pair comprising a first transistor receiving the first voltage and a second transistor receiving the second voltage.

According to an embodiment, the first transistor is a MOS transistor having its gate receiving the first voltage and the second transistor is a MOS transistor having its gate receiving the second voltage.

According to an embodiment, the optoelectronic circuit comprises, for each conduction circuit, a capacitor coupled to the conduction circuit or integrated to the conduction circuit, the first current mirror comprising a capacitor charge circuit and the second current mirror comprising a capacitor discharge circuit.

According to an embodiment, each conduction circuit comprises a MOS transistor.

According to an embodiment, the first current mirror comprises, for each conduction circuit, a first copying block coupled to the gate of the MOS transistor of the conduction circuit and capable of supplying the first current multiplied by the first copying factor and the second current mirror comprises, for each conduction circuit, a second copying block coupled to the gate of the MOS transistor of the conduction circuit and capable of supplying the second current multiplied by the second copying factor.

According to an embodiment, the optoelectronic circuit comprises a current source coupled to said node.

According to an embodiment, the current source comprises at least one resistor.

According to an embodiment, the current source is capable of supplying a current which increases with the rank of the assembly having the conduction circuit coupled thereto.

According to an embodiment, the third voltage varies according to temperature.

The foregoing and other features and advantages will be discussed in detail in the following non-limiting description of specific embodiments in connection with the accompanying drawings.

DETAILED DESCRIPTION OF THE PRESENT EMBODIMENTS

Figure 1:
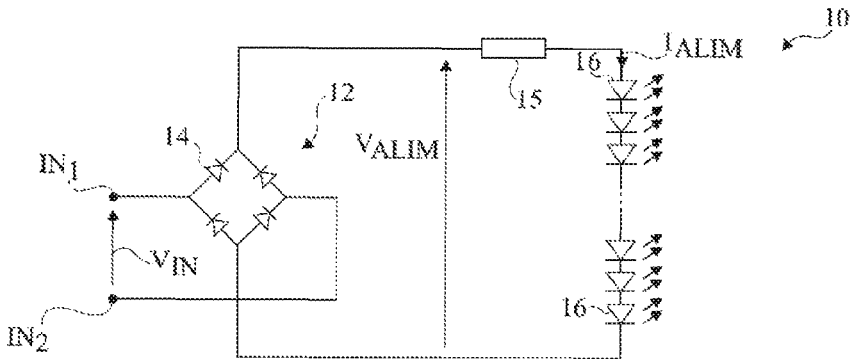
FIG. 1, previously described, is an electric diagram of an example of an optoelectronic circuit comprising light-emitting diodes.
Figure 2:
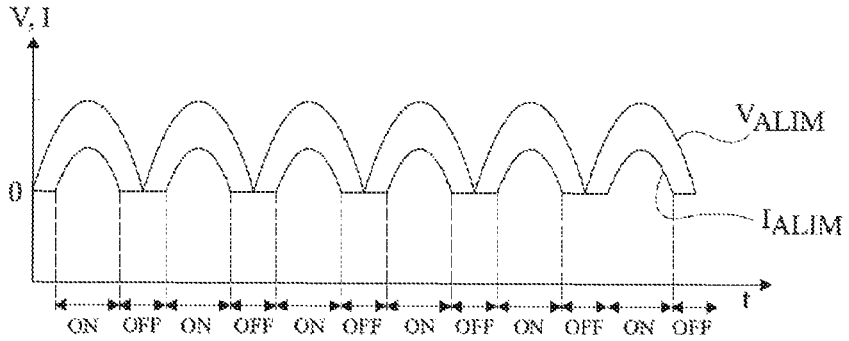
FIG. 2, previously described, is a timing diagram of the power supply voltage and current of the light-emitting diodes of the optoelectronic circuit of FIG. 1.

For clarity, the same elements have been designated with the same reference numerals in the various drawings and, further, the various drawings are not to scale. Unless otherwise specified, expressions "approximately", "substantially", and "in the order of" mean to within 10%, preferably to within 5%. Further, a signal which alternates between a first constant state, for example, a low state, noted "0", and a second constant state, for example, a high state, noted "1", is called "binary signal". The high and low states of different binary signals of a same electronic circuit may be different. In particular, the binary signals may correspond to voltages or to currents which may not be perfectly constant in the high or low state. Further, in the present description, term "connected" is used to designate a direct electric connection, with no intermediate electronic component, for example, by means of a conductive track, and term "coupled" or term "linked" will be used to designate either a direct electric connection (then meaning "connected") or a connection via one or a plurality of intermediate components (resistor, capacitor, etc.). In the following description, the ratio of the active power consumed by the electronic circuit to the product of the effective values of the current and of the voltage powering the electronic circuit is called "power factor".

Figure 3:
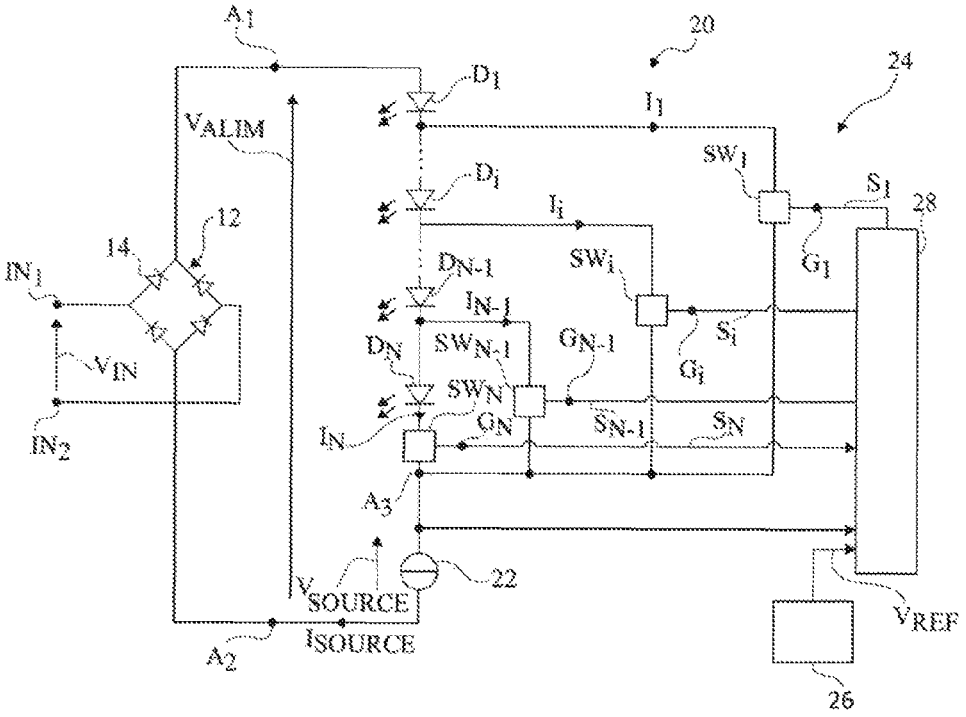
FIG. 3 shows an electric diagram of an embodiment of an optoelectronic circuit comprising light-emitting diodes.

FIG. 3 shows an electric diagram of an embodiment of an optoelectronic circuit 20 comprising a light-emitting diode switching device and illustrating the general operating principle of the optoelectronic circuit. The elements of optoelectronic circuit 20 common with optoelectronic circuit 10 are designated with the same reference numerals. In particular, optoelectronic circuit 20 comprises rectifying circuit 12 receiving power supply voltage $V_{IN}$ between terminals $IN_1$ and $IN_2$ and supplying rectified voltage $V_{ALIM}$ between nodes $A_1$ and $A_2$. As a variation, circuit 20 may directly receive a rectified voltage, and it is then possible for the rectifying circuit not to be present. The potential at node $A_2$ may correspond to a low reference potential $V_{off}$, for example, 0 V, having the voltages of optoelectronic circuit 20 referenced thereto. Unless otherwise mentioned, the potentials are referenced in the following description to low reference potential $V_{off}$. A high reference potential, called $V_{on}$, may be supplied from power supply voltage $V_{ALIM}$.

Optoelectronic circuit 20 comprises N series-connected assemblies of elementary light -emitting diodes, called general light-emitting diodes $D_i$ in the following description, where i is an integer in the range from 1 to N and where N is an integer in the range from 2 to 200. Each general light-emitting diode $D_1$ to $D_N$ comprises at least one elementary light-emitting diode. Preferably, each general light-emitting diode is formed of the series and/or parallel assembly of at least two elementary light-emitting diodes. In the present example, the N general light -emitting diodes $D_i$ are series-connected, the cathode of general light-emitting diode $D_i$ being coupled to the anode of general light-emitting diode $D_{i+1}$, for i varying from 1 to N−1. The anode of general light-emitting diode $D_1$ is coupled preferably connected, to node $A_1$. General light -emitting diodes $D_i$, with i varying from 1 to N, may comprise the same number of elementary light-emitting diodes or different numbers of elementary light-emitting diodes.

Optoelectronic circuit 20 comprises a current source 22 having a terminal coupled to node $A_2$ and having its other terminal coupled to a node $A_3$. Current source 22 may have any structure and may in particular correspond to an impedance, for example, a resistor. The cathode of general light-emitting diode $D_N$ is coupled, preferably connected, to node $A_3$. Call $V_{SOURCE}$ the voltage across current source 22 and $I_{SOURCE}$ the current flowing through current source 22. Optoelectronic circuit 20 may comprise a circuit, not shown, which supplies a reference voltage to power the current source, possibly obtained from voltage $V_{ALIM}$. Current source 22 may be continuously controlled by a circuit external to optoelectronic circuit 20.

Circuit 20 comprises a device 24 for switching general light-emitting diodes $D_i$, with i varying from 1 to N. According to an embodiment, device 24 comprises:

a circuit 26 for supplying a reference voltage $V_{REF}$;

a control circuit 28 capable of receiving voltages $V_{SOURCE}$ and $V_{REF}$; and N conduction circuits $SW_1$ to $SW_N$, each conduction circuit $SW_i$, with i varying from 1 to N, being assembled between node $A_3$ and the cathode of general light-emitting diode $D_i$ and being controlled by a signal $S_i$ supplied by control circuit 28.

Conduction circuit $SW_i$ is a circuit having an equivalent electric resistance varying between a maximum value and a minimum value according to signal $S_i$. According to an embodiment, when the equivalent electric resistance of conduction circuit $SW_i$ is at the maximum value, conduction circuit $SW_i$ is substantially equivalent to an off switch. As a variation, current may flow through circuit $SW_i$ even when the equivalent electric resistance of conduction circuit $SW_i$ is the highest. For i varying from 1 to N, call $I_i$ the current flowing through conduction circuit $SW_i$. In the following description, call $G_i$ a node coupled to the conduction circuit and receiving signal $S_i$. As a variation, it is possible for conduction circuit $SW_N$, which protects current source 22 from overvoltages, not to be controlled by control unit 28 and to still be on or to be absent, and for the cathode of general light-emitting diode $D_N$ to be connected to node $A_3$. Optoelectronic circuit 20 may further comprise a circuit, not shown, which supplies a reference voltage for the power supply of switching device 24, possibly obtained from voltage $V_{ALIM}$.

In the present embodiment, the control signal Si of each conduction circuit $SW_i$ is a signal which may continuously vary between a first value and a second value, the equivalent electric resistance of conduction circuit SW decreasing when signal $S_i$ varies front the first value to the second value. The first and second values of signals $S_i$, with i varying from 1 to N, may not be the same for all conduction circuits $SW_i$. Preferably, conduction circuit $SW_i$ is substantially not conductive when signal $S_i$ is at the first value.

According to an embodiment, each conduction circuit $SW_i$ is, for example, made of at least one transistor, particularly an enrichment or depletion metal-oxide gate field-effect transistor or MOS transistor. Signal Si then is the potential at the gate of transistor $SW_i$. According to an embodiment, each conduction circuit $SW_i$ comprises an N-channel enrichment MOS transistor having its drain connected to the cathode of general light-emitting diode $D_i$, having its source coupled to node $A_3$ and having as gate coupled to node $G_i$. According to another embodiment, conduction circuit $SW_i$ comprises two transistors MOS, for example, with are N channel between the cathode of general light-emitting diode $D_i$ and node $A_3$, the transistor connected to general light-emitting diode $D_i$ being a cascade assembled high-voltage transistor and the transistor connected to node $A_3$ being a low-voltage transistor controlled by signal $S_i$. This advantageously enables to increase the switching speed of conduction circuit $SW_i$. As a variation, each conduction circuit may correspond to a transistor other than a MOS transistor, to a relay, to a microelectromechanical system, and generally to any element having a electric conductivity capable of being monotonously voltage- or current-controlled.

According to an embodiment, circuit 26 for supplying reference voltage $V_{REF}$ is internal to optoelectronic circuit 20. As a variation, reference voltage $V_{REF}$ is supplied to optoelectronic circuit 20 by a circuit external to optoelectronic circuit 20 or is obtained from a modulation signal supplied to optoelectronic circuit 20 by a circuit external to optoelectronic circuit 20. As an example, optoelectronic circuit 20 may comprise a terminal dedicated to the reception of reference voltage $V_{REF}$ or of the modulation signal from which reference voltage $V_{REF}$ is obtained. According to an embodiment, reference voltage $V_{REF}$ or the modulation signal may be supplied by a dimmer, particularly a dimmer capable of being actuated by a user or a luminosity sensor.

Figure 4:
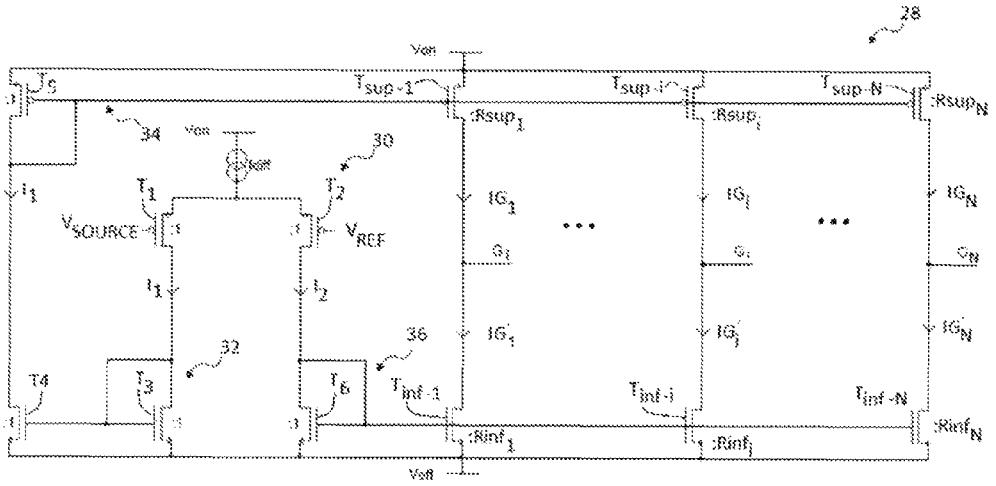
FIG. 4 shows a more detailed electric diagram of an embodiment of the control circuit of the optoelectronic circuit shown in FIG. 3.

FIG. 4 shows an electric diagram of an embodiment of control circuit 28. Control circuit 28 comprises a transconductance operational amplifier comprising a differential pair 30 and current mirrors 32, 34, and 36. In the present embodiment, signal $S_i$ corresponds to the potential at node $G_i$.

Differential pair 30 comprises a transistor $T_1$, for example, a P-channel MOS transistor having its source coupled to a terminal of a current source $I_{diff}$ and having its gate controlled by voltage $V_{SOURCE}$. The other terminal of current source $I_{diff}$ may be coupled to the source of high reference potential $V_{on}$. Differential pair 30 further comprises a transistor $T_2$, for example, a P -channel MOS transistor having its source coupled to current source $I_{diff}$ and having its gate controlled by voltage $V_{REF}$. Call I1 the current at the drain of transistor $T_1$ and $I_2$ the current at the drain of transistor $T_2$. According to an embodiment, transistors $T_1$ and $T_2$ have the same characteristics. In particular, the form factor (W/L) of the channel of transistor $T_1$ is equal to the form factor of the channel of transistor $T_2$. The form factor of the channel of a transistor designates the ratio of the width to the length of the channel. In the following description, the form factor of the channel of transistor $T_3$ is taken as the reference form factor.

Current mirror 32 comprises a transistor $T_3$, for example, an N-channel MOS transistor, having its drain coupled, preferably connected, to the drain of transistor $T_1$, having its source coupled, preferably connected, to the source of low reference potential $V_{off}$, for example, node $A_2$, and having its gate coupled to the drain. Current mirror 32 comprises a transistor $T_4$, for example, an N-channel MOS transistor, having its source coupled, preferably connected, to the source of low reference potential source $V_{off}$ and having its gate coupled to the gate of transistor $T_3$. According to an embodiment, transistors $T_3$ and $T_4$ have the same characteristics. In particular, the form factor of the channel of transistor $T_3$ is equal to the form factor of the channel of transistor $T_4$. The current flowing through transistor $T_4$ is thus equal to $I_1$ flowing through $T_3$.

Current mirror 34 comprises a transistor $T_5$, for example, a P-channel MOS transistor, having its drain coupled, preferably connected, to the drain of transistor $T_4$, having its source coupled, preferably connected, to the source of low reference potential $V_{on}$, and having its gate coupled to its drain. Current mirror 34 further comprises for each conduction circuit $SW_i$, with i varying from 1 to N, a transistor $T_{sup-i}$, for example, a P-Channel MOS transistor having its source coupled, preferably connected, to high reference potential source $V_{on}$, having its gate coupled to the gate of transistor $T_5$ and having its drain coupled, preferably connected, to node $G_i$. According to an embodiment, it is possible for transistors $T_{sup-i}$ not to have the same characteristics with respect to one another and with respect to transistor $T_5$. Call $R_{sup-i}$ the ratio of the form factor of the channel of transistor $T_{sup-i}$ to the form factor of the channel of transistor $T_5$. In particular, $R_{sup-i}$ may be different from $R_{sup-j}$, i being different from j. Call $IG_i$ the current at the drain of transistor $T_{sup-i}$.

Current mirror 36 comprises a transistor $T_6$, for example, an N-channel MOS transistor, having its drain coupled, preferably connected, to the drain of transistor $T_2$, having its source coupled, preferably connected, to the source of low reference potential $V_{off}$, and having its gate coupled to its drain. Current mirror 36 further comprises for each conduction circuit $SW_i$, with i varying from 1 to N, a MOS transistor $T_{inf-i}$, for example, an N-channel MOS transistor, having its source coupled, preferably connected, to low reference potential source $V_{off}$, having its gate coupled to the gate of transistor $T_6$, and having its drain coupled, preferably connected, to node $G_i$. According to an embodiment, it is possible for transistors $T_{inf-i}$ not to have the same characteristics with respect to one another and with respect to transistor $T_6$. Call $R_{inf-i}$ the ratio of the form factor of the channel of transistor $T_{inf-i}$ to the form factor of the channel of transistor $T_6$. In particular, $R_{inf-i}$ may be different from $R_{inf-j}$, i being different from j. Call $IG'_i$ the current at the drain of transistor $T_{inf-i}$.

For i varying from 1 to N, call $RatioPN_i$ the ratio of the form factor of the channel of transistor $T_{sup-i}$ to the form factor of the channel of transistor $T_{inf-i}$, that is, the ratio of $R_{sup-i}$ to $R_{inf-i}$. According to an embodiment, ratio $RatioPN_i$ is greater than ratio $RatioPN_j$ for i greater than j. According to an embodiment, for i varying from 1 to N, ratio $RatioPN_i$ may vary from 1/N to N. According to an embodiment, the difference between $RatioPN_i$ and $RatioPN_{i+1}$ is greater than 1/(N−1)−1/N.

To explain the operation of optoelectronic circuit 20, a control circuit having a simplified structure will first be considered.

Figure 5:
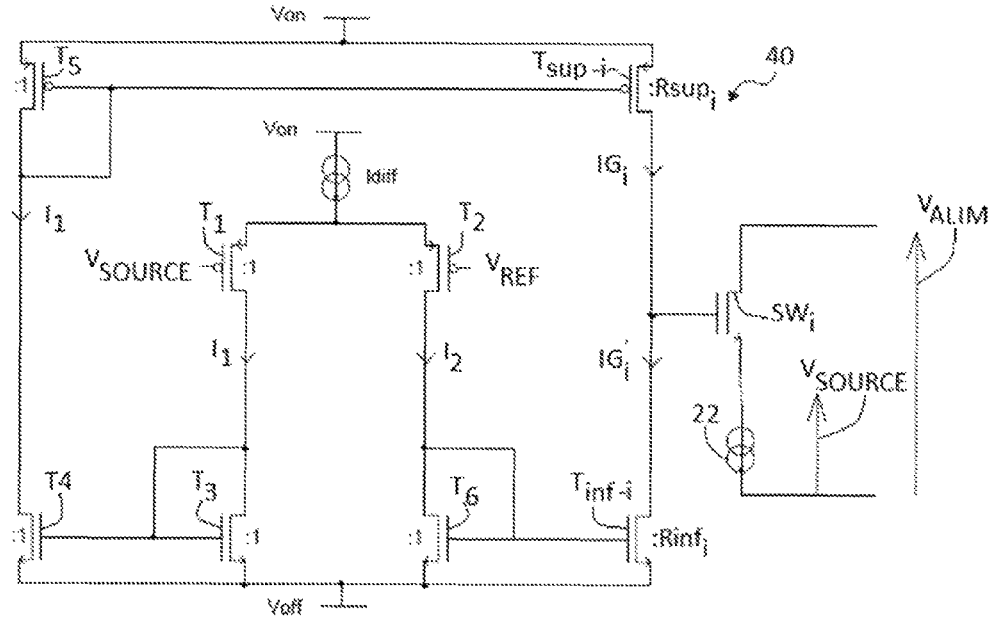
FIG. 5 shows a simplified electric diagram illustrating the operation of the control circuit shown in FIGS. 4.

FIG. 5 shows an electric diagram of a control circuit 40 comprising all the elements of control circuit 28 shown in FIG. 4, with the difference that a single conduction circuit $SW_i$ is present and that the light-emitting diodes are not present.

First consider that ratios $R_{sup-i}$ and $R_{inf-i}$ are equal to 1. In this case, current $IG_i$ is equal to current $I_1$ and current $IG'_i$ is equal to current $I_2$. At equilibrium, voltage $V_{SOURCE}$ is equal to voltage $V_{REF}$, currents $I_1$, $I_2$, $IG_i$, and $IG'_i$ are equal to $I_{diff}/2$, and the potential at node $G_i$ is equal to the sum of voltage $V_{SOURCE}$ and of the gate-source voltage of transistor $SW_i$. When voltage $V_{SOURCE}$ becomes greater than voltage $V_{REF}$, transistor $T_1$ conducts less than transistor $T_2$, so that current $I_1$ becomes lower than current $I_2$. Current $IG_i$ decreases with respect to current $IG'_i$. Due to the capacitance of node $G_i$, this causes a decrease in the voltage at the gate of transistor $SW_i$. Transistor $SW_i$ thus becomes less conductive and voltage $V_{SOURCE}$ decreases until it is equal to $V_{REF}$ again. When voltage $V_{SOURCE}$ becomes lower than voltage $V_{REF}$, transistor $T_1$ conducts more than transistor $T_2$, so that current $I_1$ becomes greater than current $I_2$. Current $IG_i$ increases with respect to current $IG'_i$. Due to the capacitance of node $G_i$, this causes an increase in the voltage at the gate of transistor $SW_i$. Transistor $SW_i$ thus becomes more conductive and voltage $V_{SOURCE}$ rises until it is equal to $V_{REF}$ again. Control circuit 40 thus controls voltage $V_{SOURCE}$ with voltage $V_{REF}$.

Now consider that the ratio of $R_{sup-i}$ to $R_{inf-i}$ is not equal to 1. The previous line of reasoning remains valid with the difference that, at equilibrium, current $I_1$ is equal to $R_{inf}i*I_{diff}/(R_{inf-i}+R_{sup-i})$, current I2 is equal to $R_{sup-i}*I_{diff}/(R_{inf-i}+R_{sup-i})$, currents $IG_i$ and $IG'_i$ are equal to $R_{inf-i}*R_{sup-i}*I_{diff}/(R_{inf-i}+R_{sup-1})$, and there is an offset voltage $OFFSET_i$ between voltage $V_{SOURCE}$ and voltage $V_{REF}$. Offset voltage $OFFSET_i$ is proportional to the difference between currents $I_1$ and $I_2$ and inversely proportional to the conductance of the differential pair. Offset voltage $OFFSET_i$ thus depends on ratio $RatioPN_i$. For the same reasons as those previously described, a variation of voltage $V_{SOURCE}$ with respect to its value at equilibrium causes a variation of the voltage at the gate of transistor $SW_i$, which tends to take voltage $V_{SOURCE}$ back to its value at equilibrium Control circuit 40 thus controls voltage $V_{SOURCE}$ with voltage $V_{REF}$ decreased by offset voltage $OFFSET_i$.

Now consider again optoelectronic circuit 20 shown in FIG. 4. Control circuit 28 supplies signals $S_1$ to $S_N$ at values capable of modifying the conduction of conduction circuits $SW_1$ to $SW_N$ so that voltage $V_{SOURCE}$ is controlled by reference voltage $V_{REF}$ to within an offset voltage OFFSET, which may vary according to the operating point of the optoelectronic circuit. An advantage of switching device 24 is that it has a decreased current consumption. According to an embodiment, in the case where each conduction circuit $SW_i$ comprises a MOS transistor having its gate receiving signal $S_i$, control circuit 28 controls voltage $V_{SOURCE}$ with reference voltage $V_{REF}$ to within an offset voltage OFFSET by controlling the gates of transistors $SW_i$. In other words, differential pair 30 receives as an input the difference between voltage $V_{SOURCE}$ and reference voltage $V_{REF}$. The reference voltage is identical for all output stages, but the offset voltage is different for each output stage.

In a rising phase of power supply voltage $V_{ALIM}$, while general light-emitting diodes $D_1$ to $D_{i-1}$ are conductive, general light-emitting diodes $D_i$ to $D_N$ are non-conductive, signals $S_1$ to $S_{i-2}$ are at $V_{off}$, signals $S_i$ to $S_N$ are at $V_{on}$, and signal $S_{i-1}$ is at a voltage equal to $V_{REF}-OFFSET_{i-1}+VGS_{i-1}$ enabling switch $SW_{i-1}$ alone to impose current $I_{SOURCE}$ in the light-emitting diodes, when the voltage across general light-emitting diode a becomes greater than the threshold voltage of general light-emitting diode $D_i$, the latter becomes conductive and a current starts flowing through general light-emitting diode $D_i$ and switch $SW_i$. This results in a temporary decrease of the total equivalent impedance between nodes $A_1$ and $A_3$, and thus in a temporary increase of voltage $V_{SOURCE}$. As previously described, the increase of voltage $V_{SOURCE}$ causes a decrease in current $I_1$ running through transistor $T_1$ of differential pair 30. Thereby, the current copied by each transistor $T_{sup-i}$ decreases for i varying from 1 to N. Given that there exists one equivalent capacitor at each node $G_i$, with 1 varying from 1 to N, capable of corresponding to a different capacitor or to a stray capacitance of another electronic component, and that $RatioPN_{i-1}$ associated with transistors $T_{sup-i-1}$ and $T_{inf-i-1}$ coupled to node $G_{i-1}$ is smaller than ratios $RatioPN_i$ to $RatioPN_N$, the voltage at node $G_{i-1}$ decreases until potential $V_{off}$ is substantially reached while the voltage at node $G_i$ also decreases down to its point of equilibrium, enabling switch $SW_i$ alone to impose voltage $V_{SOURCE}$ at $V_{REF}-OFFSET_i$. Switch $SW_{i-1}$ thus turns off and, simultaneously, switch $SW_i$ becomes less and less conductive. The entire current then flows through switch $SW_i$. Control unit 28 then controls voltage $V_{SOURCE}$ with voltage $V_{REF}$ decreased by $OFFSET_i$ by means of conduction circuit $SW_i$, offset voltage $OFFSET_i$ between voltage $V_{SOURCE}$ and voltage $V_{REF}$ being smaller than offset voltage $OFFSET_{i-1}$. In the case where each conduction circuit $SW_i$ comprises a MOS transistor having its gate receiving signal $S_i$, this means that the voltage at the gate of transistor $SW_{i-1}$ decreases and transistor $SW_{i-1}$ becomes less and less conductive until it reaches its non-conductive state. At equilibrium, the potential at node $G_i$ is equal to the sum of voltage $V_{SOURCE}$ and of the gate-source voltage of transistor $SW_i$.

In a falling phase of power supply voltage $V_{ALIM}$, while general light-emitting diodes $D_1$ to $D_i$ are conductive, general light-emitting diodes $D_{i+1}$ to $D_N$ are non-conductive, signals $S_1$ to $S_{i-1}$ are at $V_{off}$, signals $S_{i+1}$ to $S_N$ are at $V_{on}$, and signal $S_i$ is at a voltage equal to $V_{REF}-OFFSET_i+V_{GSi}$ enabling switch $SW_i$ alone to impose current $I_{SOURCE}$ in the light-emitting diodes, when the voltage across general light-emitting diode $D_i$ decreases and becomes smaller than the threshold voltage of general light-emitting diode $D_i$, the latter starts becoming non-conductive. This results in a temporary increase of the total equivalent impedance between nodes $A_1$ and $A_3$, and thus in a temporary decrease of voltage $V_{SOURCE}$. As previously described, the decrease of voltage $V_{SOURCE}$ causes an increase in current $I_1$ running through transistor $T_1$ of differential pair 30. Thereby, the current copied by each transistor $T_{sup-i}$ increases. Given that there exists an equivalent capacitor at each node $G_i$, and that ratio $RatioPN_i$ of branch i is greater than ratio $RatioPN_1$ to $RatioPN_{i-1}$, the voltage at node $G_i$ increases until it substantially reaches potential $V_{on}$ while the voltage at node $G_{i-1}$ also increases up to its point of equilibrium enabling switch $SW_{i-1}$ alone to impose voltage $V_{SOURCE}$ at $V_{REF}-OFFSET_{i-1}$. Switch $SW_i$ becomes totally conductive and switch $SW_{i-1}$ becomes more and more conductive. The entire current then flows through switch $SW_{i-1}$. Control unit 28 then controls voltage $V_{SOURCE}$ with voltage $V_{REF}$ decreased by $OFFSET_{i-1}$ by means of conduction circuit $SW_{i-1}$, offset voltage $OFFSET_{i-1}$ being higher than offset voltage $OFFSET_i$. In the case where each conduction circuit $SW_i$ comprises a MOS transistor having its gate receiving signal $S_i$, this means that the voltage at the gate of transistor $SW_{i-1}$ increases and that transistor $SW_{i-1}$ becomes more and more conductive and transistor $SW_i$ reaches its totally conductive state.

An advantage of the present embodiment is that control circuit 28 comprises no finite state machines and that the order of the control of conduction circuits SWi is imposed by the differences between ratios RatioPNi.

Advantageously, the embodiment of the previously-described method of controlling switches SWi does not depend on the number of elementary light-emitting diodes which form each general light-emitting diode Di and thus does not depend on the threshold voltage of each general light-emitting diode.

Considering that diodes $D_1$ to $D_i$ are conductive and that general light-emitting diodes $D_{i+1}$ to $D_N$ are non-conductive, offset voltage $OFFSET_i$ decreasing with index i, the voltage at which voltage $V_{SOURCE}$ stabilizes increases with index i. Thereby, current $I_{SOURCE}$ flowing through general light-emitting diodes $D_1$ to $D_i$ increases with index i. A staged increase of current $I_{SOURCE}$ with voltage $V_{ALIM}$ is thus obtained. Advantageously, the power factor of the optoelectronic circuit is thus increased.

According to another embodiment, circuit 26 for supplying reference voltage $V_{REF}$ is capable of modifying the value of reference voltage $V_{REF}$ among a plurality of values according to a control signal supplied by control unit 28. According to an embodiment, considering that diodes $D_1$ to $D_i$ are conductive and that general light-emitting diodes $D_{i+1}$ to $D_N$ are non -conductive, circuit 26 is controlled to increase the value of reference voltage $V_{REF}$ with index i. The voltage at which voltage $V_{SOURCE}$ stabilizes then increases with index i, independently from the previously-described increase due to the variation of offset voltage $OFFSET_i$. Thereby, current $I_{SOURCE}$ flowing through general light-emitting diodes $D_1$ to $D_i$ increases with index i. A staged increase of current $I_{SOURCE}$ with voltage $V_{ALIM}$ is thus obtained. Advantageously, the power factor of the optoelectronic circuit is thus increased.

According to another embodiment, current source 22 is capable of supplying a current $I_{SOURCE}$ having an intensity which may take a plurality of values according to a control signal supplied by control unit 28. According to an embodiment, considering that diodes $D_1$ to $D_i$ are conductive and that general light-emitting diodes $D_{i+1}$ to $D_N$ are non-conductive, current source 22 is controlled to increase current intensity $I_{SOURCE}$ with index i. Advantageously, the power factor of the optoelectronic circuit is thus increased.

Offset voltage $OFFSET_i$ for a given i may be constant or vary according to temperature, either by increasing when the temperature increases, or by decreasing when the temperature increases. In the case where current source 22 is a resistor and offset voltage $OFFSET_i$ decreases when the temperature increases, a temperature increase results in a decrease of current $I_{SOURCE}$ and thus in a decrease of the thermal power supplied by optoelectronic circuit 20. A protection of optoelectronic circuit 20 against a thermal runaway is thus obtained.

Figure 6:
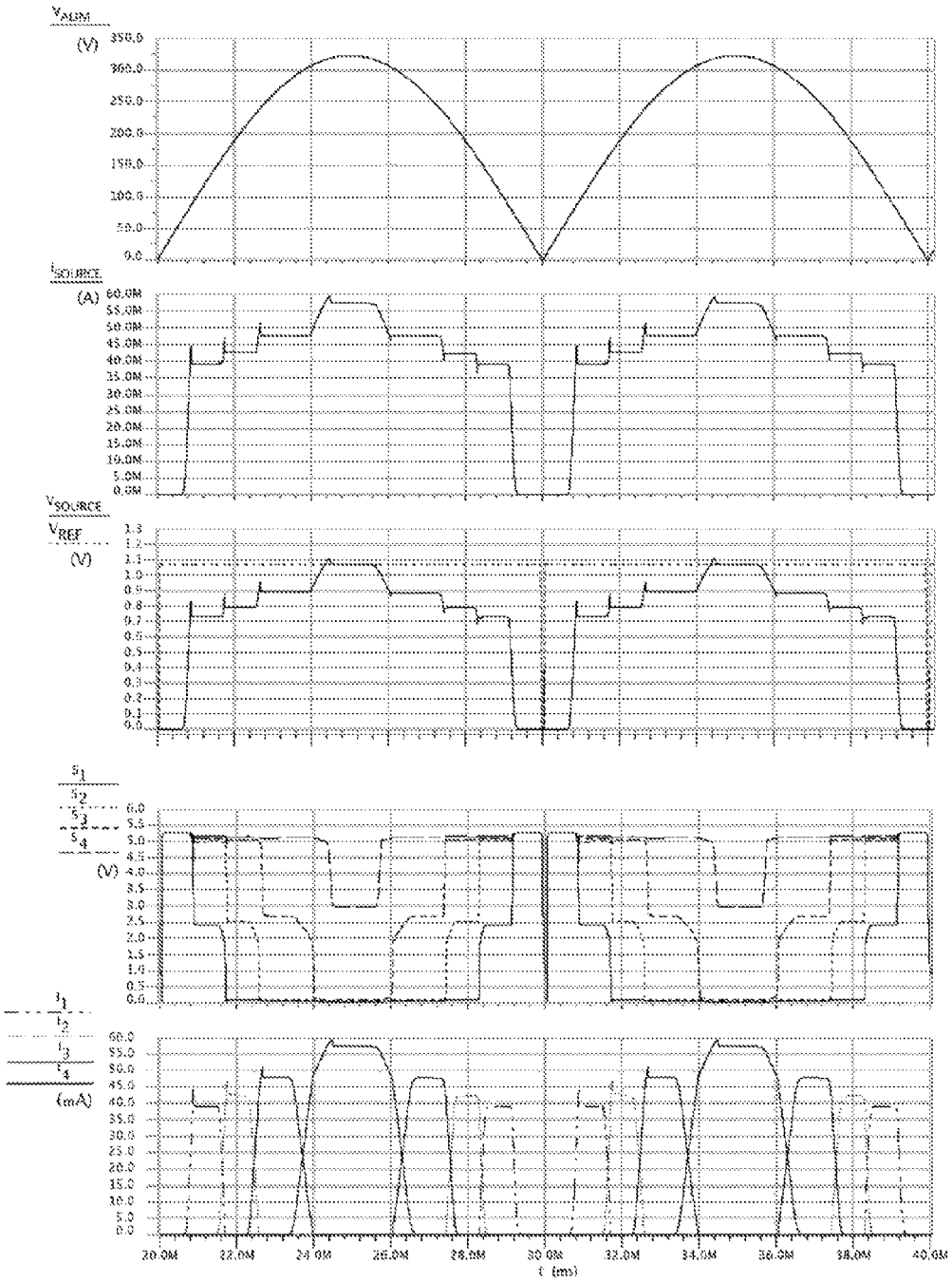
FIG. 6 shows timing diagrams of voltages and of currents during the operation of an embodiment of the optoelectronic circuit of FIG. 3.

FIG. 6 shows timing diagrams, obtained by simulation, of voltage $V_{ALIM}$, of current $I_{SOURCE}$, of voltages $V_{SOURCE}$ and $V_{REF}$, of voltages $S_1$, $S_2$, $S_3$, and $S_4$ and of currents $I_1$, $I_2$, $I_3$, and $I_4$ in the case where voltage $V_{ALIM}$ is obtained from a sinusoidal voltage $V_{IN}$ and in the case where N is equal to 4. To obtain the curves shown in FIG. 6, ratio $RatioPN_1$ was equal to ¼, ratio $RatioPN_2$ was equal to ⅓, ratio $RatioPN_3$ was equal to ½, and $RatioPN_4$ was equal to 1, and the intensity of the current supplied by current source $I_{diff}$ equal to 20 μA.

Specific embodiments have been described. Various alterations, modifications, and improvements will readily occur to those skilled in the art. Although detailed embodiments have been described, where the least electrically conductive conduction state of each conduction circuit $SW_i$ corresponds to a non-conductive state, it should be clear that these embodiments may also be implemented with a conduction circuit $SW_i$ for which the least electrically conductive state however corresponds to a state where current flows through circuit $SW_i$, for example, a current having an intensity smaller than or equal to the theoretical limit, which is the maximum intensity inducing power in conduction circuit $SW_i$ capable of being dissipated without causing a malfunction thereof.

Further, in the previously-described embodiments, each transistor $T_{sup-i}$ is capable of copying current $I_1$ multiplied by copying factor $R_{supi}$ and each transistor $T_{inf-i}$ is capable of copying current $I_2$ multiplied by copying factor $R_{infi}$. As a variation, each transistor $T_{inf-i}$ may be capable of copying a reference current, for example, a constant current, and each transistor $T_{sup-i}$ is capable, of copying current $I_1$ multiplied by copying factor $R_{supi}$. As a variation, each transistor $T_{sup-i}$ may be capable of copying a reference current, for example, a constant current, and each transistor $T_{inf-i}$ is capable of copying current $I_2$ multiplied by copying factor $R_{infi}$. Different ratios $RatioPN_i$ for each conduction circuit $SW_i$ and different offset voltages $OFFSET_i$ for conduction circuit $SW_i$ may thus also be obtained.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. An optoelectronic circuit intended to receive a variable voltage containing an alternation of rising and falling phases, the optoelectronic circuit comprising:

assemblies of series-assembled light-emitting diodes;

a node coupled to each assembly by a conduction circuit having an electric conductance which varies according to a control signal; and a control circuit coupled to each conduction circuit, comprising a difference amplifier and as many output stages as there are conduction circuits, and capable of supplying each control signal based on the comparison of a first voltage at said node with at least a second voltage identical for all conduction circuits, the control circuit being capable of controlling the first voltage with the second voltage offset by a third voltage, different for each output stage.

2. The optoelectronic circuit of claim 1, wherein the difference amplifier receives as an input a differential voltage corresponding to the difference between the first voltage and the second voltage.

3. The optoelectronic circuit of claim 1, wherein the difference amplifier is capable of supplying a first current and a second current, the control circuit comprising a first current mirror with a plurality of outputs capable of copying, for each conduction circuit, the first current or a third current multiplied by a first copying factor, and a second current mirror with a plurality of outputs capable of copying, for each conduction circuit, the second current or the third current multiplied by a second copying factor, the ratio of the first copying factor to the second copying factor being different for each conduction circuit.

4. The optoelectronic circuit of claim 3, comprising, for each conduction circuit, a capacitor coupled to the conduction circuit or integrated to the conduction circuit, the first current mirror comprising a capacitor charge circuit and the second current mirror comprising a capacitor discharge circuit.

5. The optoelectronic circuit of claim 4, wherein each conduction circuity comprises a MOS transistor, and wherein the first current mirror comprises, for each conduction circuit, a first copying block coupled to the gate of the MOS transistor of the conduction circuit and capable of supplying the first current multiplied by the first copying factor and wherein the second current mirror comprises, for each conduction circuit, a second copying block coupled to the gate of the MOS transistor of the conduction circuit and capable of supplying the second current multiplied by the second copying factor.

6. The optoelectronic circuit of claim 1, wherein the assemblies of light-emitting diodes are ordered by increasing ranks from a first assembly at a first end of the series to a last assembly at a second end of the series and wherein, for each conduction circuit, the control circuit is capable of controlling the first voltage with the second voltage decreased by a third voltage which decreases with the rank of the assembly having the conduction circuit coupled thereto.

7. The optoelectronic circuit of claim 6, comprising a current source coupled to said node, and wherein the current source is capable of supplying a current which increases with the rank of the assembly having the conduction circuit coupled thereto.

8. The optoelectronic circuit of claim 1, wherein the difference amplifier comprises a differential pair comprising a first transistor receiving the first voltage and a second transistor receiving the second voltage.

9. The optoelectronic circuit of claim 8, wherein the first transistor is a MOS transistor having its gate receiving the first voltage and wherein the second transistor is a MOS transistor having its gate receiving the second voltage.

10. The optoelectronic circuit of claim 1, wherein each conduction circuit comprises a MOS transistor.

11. The optoelectronic circuit of claim 1, comprising a current source coupled to said node.

12. The optoelectronic circuit of claim 11, wherein the current source comprises at least one resistor.

13. The optoelectronic circuit of claim 1, wherein the third voltage varies according to temperature.

* * * * *